US010730651B2

(12) United States Patent
Green

(10) Patent No.: US 10,730,651 B2
(45) Date of Patent: Aug. 4, 2020

(54) BLISTER PACKAGING DEVICE HAVING INVERTING NESTING TRAY AND METHOD

(71) Applicant: Robert Green, San Diego, CA (US)

(72) Inventor: Robert Green, San Diego, CA (US)

( * ) Notice: Subject to any disclaimer, the term of this patent is extended or adjusted under 35 U.S.C. 154(b) by 246 days.

(21) Appl. No.: 15/683,680

(22) Filed: Aug. 22, 2017

(65) Prior Publication Data

US 2018/0050831 A1 Feb. 22, 2018

Related U.S. Application Data

(60) Provisional application No. 62/378,036, filed on Aug. 22, 2016.

(51) Int. Cl.

| | |
|---|---|
| ***B65B 51/10*** | (2006.01) |
| ***B65B 9/02*** | (2006.01) |
| ***B65B 7/28*** | (2006.01) |
| ***B65B 51/14*** | (2006.01) |

(52) U.S. Cl.

CPC ..... *B65B 51/10* (2013.01); *B65B 7/2878* (2013.01); *B65B 9/02* (2013.01); *B65B 51/14* (2013.01)

(58) Field of Classification Search

CPC ..... B65B 51/10; B65B 51/14; B65B 9/02; B65B 7/2878; B29C 66/00441; B29C 66/849; B29C 65/00; B29C 65/18

USPC ..... 53/329.2, 329.3; 156/583.1, 580, 539

See application file for complete search history.

(56) References Cited

U.S. PATENT DOCUMENTS

| | | | | |
|---|---|---|---|---|
| 5,379,572 | A * | 1/1995 | Giovannone | B29C 65/004 53/329.3 |
| 6,287,414 | B1 * | 9/2001 | Green | B29C 65/7882 156/539 |
| 2002/0014313 | A1 * | 2/2002 | Green | B29C 65/18 156/583.1 |
| 2003/0213555 | A1 * | 11/2003 | Bernardi | B29C 65/18 156/292 |
| 2008/0197045 | A1 * | 8/2008 | Metzger | B65D 75/327 206/539 |
| 2009/0133364 | A1 * | 5/2009 | Oliver | B29C 65/18 53/329.2 |
| 2011/0139661 | A1 * | 6/2011 | Ludwig | B29C 65/18 206/462 |

* cited by examiner

*Primary Examiner* — Andrew M Tecco
*Assistant Examiner* — Nicholas E Igbokwe
(74) *Attorney, Agent, or Firm* — Steins & Associates, P.C.

(57) ABSTRACT

A Blister Packaging Device having an Invertible Nesting Tray and Method of Use. The nesting tray is defined by blister nests on opposing sides of the same tray, so as to allow the user to flip over the nesting tray to dump a just-completed blister package, while simultaneously loading the nest on the opposing side of the tray for the sealing of a new blister package. In addition to being invertible, the nesting tray is slidable from a distal position to a sealing position (under the heating press plate) along a pair of parallel rails. Nesting trays are removable from the parallel rails so that they can be exchanged with nesting trays for forming blister packages of another configuration. By elimination of a rotating turntable of nesting trays, the Device provides a more compact blister packaging machine than was previously possible.

16 Claims, 15 Drawing Sheets

"SEALING POSITION"

"TRANSITIONAL ZONE POSITION"

"DISTAL POSITION"

BLISTER PACKAGING DEVICE HAVING INVERTING NESTING TRAY AND METHOD

This application is filed within one year of, and claims priority to Provisional Application Ser. No. 62/378,036, filed Aug. 22, 2016.

BACKGROUND OF THE INVENTION

1. Field of the Invention

This invention relates generally to packaging equipment and, more specifically, to a Blister Packaging Device having an Invertible Nesting Tray and Method of Use.

2. Description of Related Art

Blister packaging has become one of the most prevalent means for packaging small- to medium-sized items for retail sale. A blister package comprises a backing card, many times made from cardboard, with designs or other information labeled thereon; a clear plastic "blister" is then sealed (over the retail item) to the backing card. These blister packages are extremely convenient and cost-effective and are particularly well-suited for hanging from the backing card. These backing cards may also be made from plastic, with a paper or cardboard insert placed in the blister with the retail item.

Prior blister sealers are adequate for the sealing task. They generally comprise at least one nesting tray on which the blisters are staged facing back-side up (i.e. the inside of the blister is up). The retail items are then placed on top of the blister (i.e. inside of it), with the face-down backing card then being laid atop the blister. The nesting tray is then placed under a heated plate; the heated plate is pressed down upon the back of the backing card for the requisite amount of time, which causes the blister to bond to the backing card, usually by melting a special bonding agent previously applied to the backing card.

Prior to the introduction of the rotary blister sealer 10 of FIGS. 1 and 2 (the subject of U.S. Pat. No. 6,716,305), these prior blister sealers are generally very large machines that have more than one work station, typically arranged about a rotatable turntable, such that one set of parts can be staged by one employee coincident with the sealing of another set of parts by another employee. The problem with these large machines is that they were not a feasible purchase for a business having medium- to low-volume packaging needs. For one thing, they were prohibitively expensive; they are also so big that they consume excessive shop space. Furthermore, they were extremely difficult to ship, move or relocate.

The blister sealing process and equipment is closely related to another process, known as "clamshell packaging". The clamshell package is plastic on the front and back side of the packaged item. The conventional manufacturing process creating the clamshell package involves gluing or sealing the edges of the two plastic halves to one another. The conventional clamshell packaging equipment suffers from the same defects as the conventional blister sealing equipment, namely, its extreme bulkiness and high cost. What is needed is a low-cost blister sealer for creating clamshell packages.

The Green device 10 has a turntable 12, with tray receivers 14 in spaced relation around its periphery. Each tray receiver 14 is configured to accept a nesting tray 16 within it. Each nesting tray 16 is custom-designed for the particular blister package or clamshell package that is being sealed. The user loads the item(s) to be sealed (i.e. the outer packaging and the contents of the packaging) into the nesting tray 16. The turntable 12 is then rotated until the loaded nesting tray 16 is aligned beneath the heating press 13. The press 13 is activated to press down on the items to be sealed and the nesting tray and applies heat and pressure to seal the clamshell/blister package. Each nesting tray 16 in the turntable are loaded and unloaded as the turntable is turned and the packages are sealed. The hot, just-sealed packages can be allowed to cool in the turntable while other packages are sealed.

The Green device has been very effective at solving the aforementioned problems, and has been very successful in serving low- to medium-volume packaging needs. However, it has been determined that even this compact design could be improved. In particular, there continues to be a need for an even smaller, more compact (and lower cost) blister packing device. This device should allow the user to easily create reliable blister packages at the lowest possible cost, while still providing reasonable throughput.

SUMMARY OF THE INVENTION

In light of the aforementioned problems associated with the prior devices and methods, it is an object of the present invention to provide a Blister Packaging Device having an Inverting Nesting Tray and Method of Use. The nesting tray should be defined by blister nests on opposing sides of the same tray, so as to allow the user to flip over the nesting tray to dump a just-completed blister package, while simultaneously loading the nest on the opposing side of the tray for the sealing of a new blister package. In addition to being invertible, the nesting tray should be slidable from a distal position to a sealing position (under the heating press plate) along a pair of parallel rails. Nesting trays should further be removable from the parallel rails so that they can be exchanged with nesting trays for forming blister packages of another configuration. By elimination of a rotating turntable of nesting trays, the Device should provide a more compact blister packaging machine than was previously possible.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Blister Packaging Device having an Invertible Nesting Tray and Method of Use.

Figure 1:
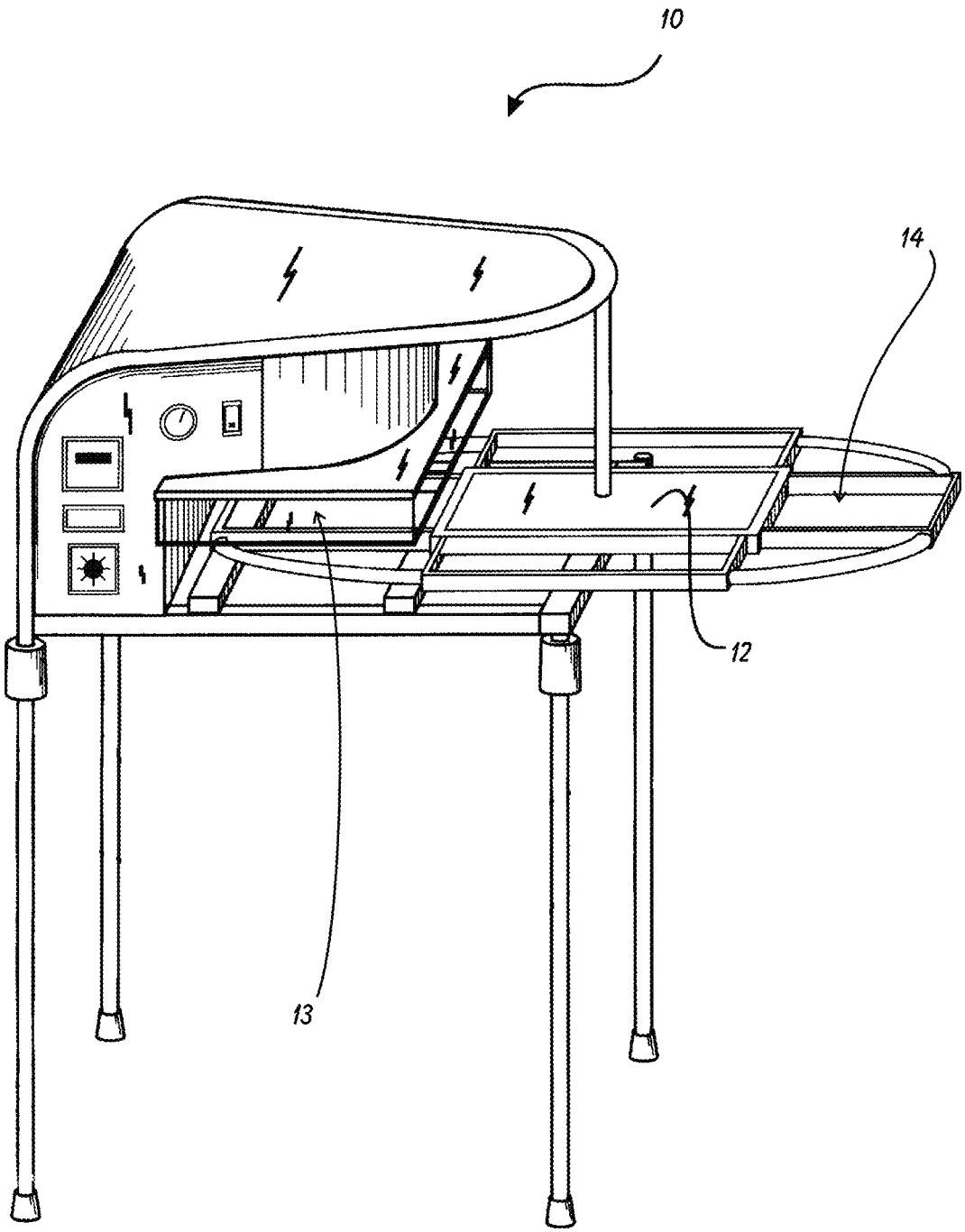
FIG. 1 PRIOR ART
FIG. 1 is a perspective view of the Rotary Blister Sealer of U.S. Pat. No. 6,716,305.
Figure 2:
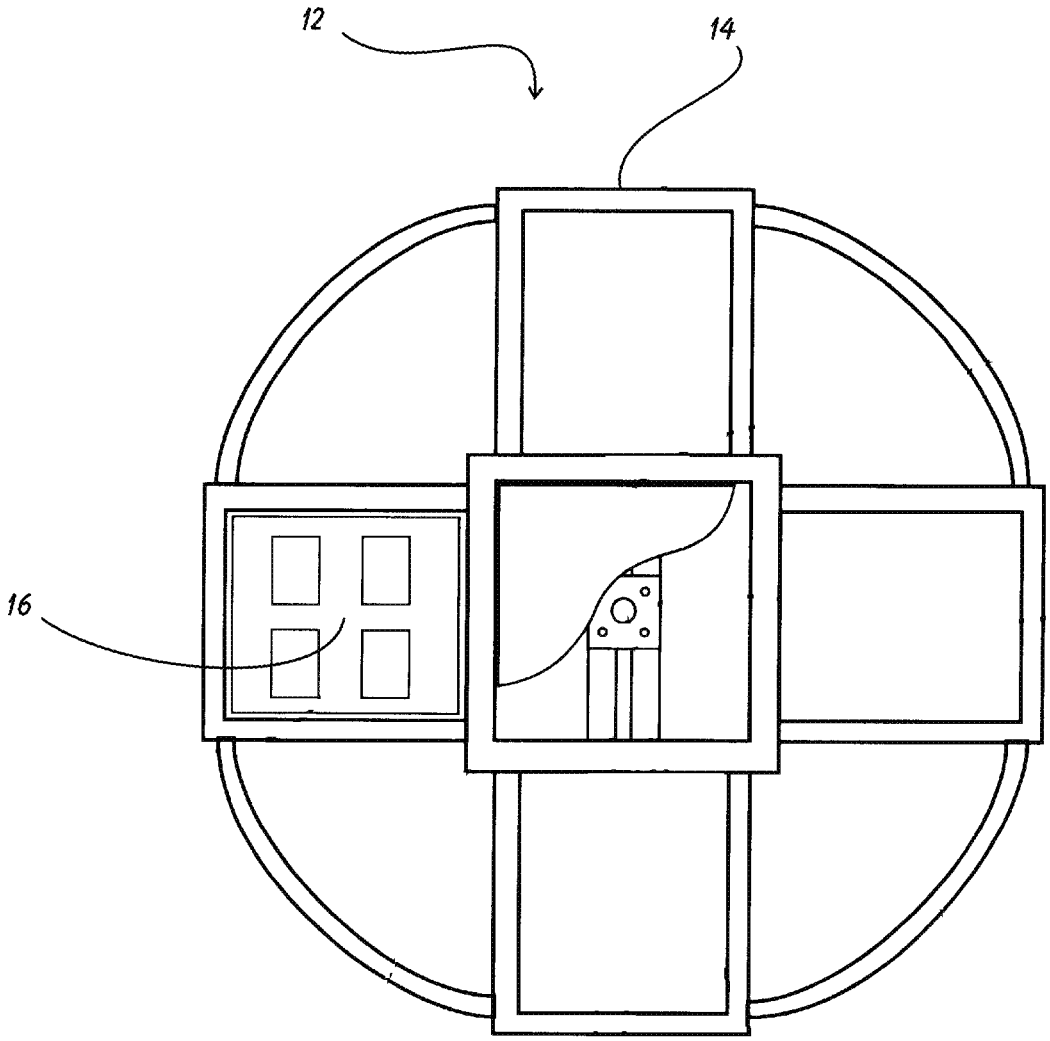
FIG. 2 PRIOR ART
FIG. 2 is a top view of the turntable thereof.
Figure 3:
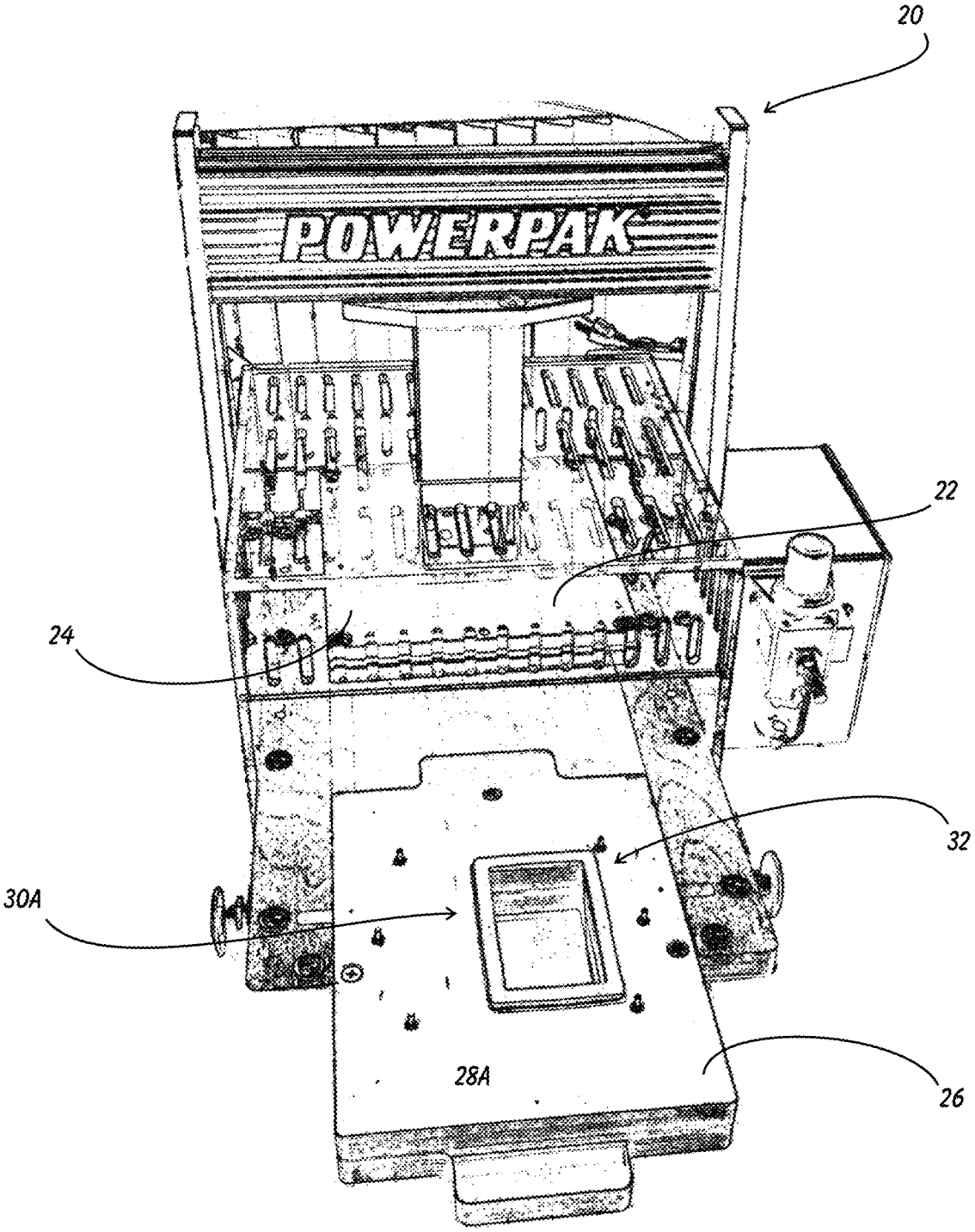
FIG. 3 is a front perspective view of a preferred embodiment of the blister sealer having an inverting nesting tray of the present invention.

The present invention can best be understood by initial consideration of FIG. 3.[1] FIG. 3 is a front perspective view of a preferred embodiment of the blister sealer having an inverting nesting tray 20 of the present invention. This sealer 20 performs essentially the same function as the prior art sealers did, but has the added benefit of providing this functionality in a much smaller, more compact package, which further has a lower cost than any similar prior device. The key to the functionality of this sealer 20 is that the nesting tray 26 is designed to invert and/or flip over in order to eject the (hot) completed blister/clamshell package, and to provide the user with an open nest in which to load a fresh set of items and packaging for sealing. By utilizing a nesting tray 26 that can be flipped over (inverted), there is no need for a turntable [12]—this reduces complexity, overall size of the device 20, and the cost of manufacturing the device 20.

[1] As used throughout this disclosure, element numbers enclosed in square brackets [ ] indicates that the referenced element is not shown in the instant drawing figure, but rather is displayed elsewhere in another drawing figure.

Figure 4:
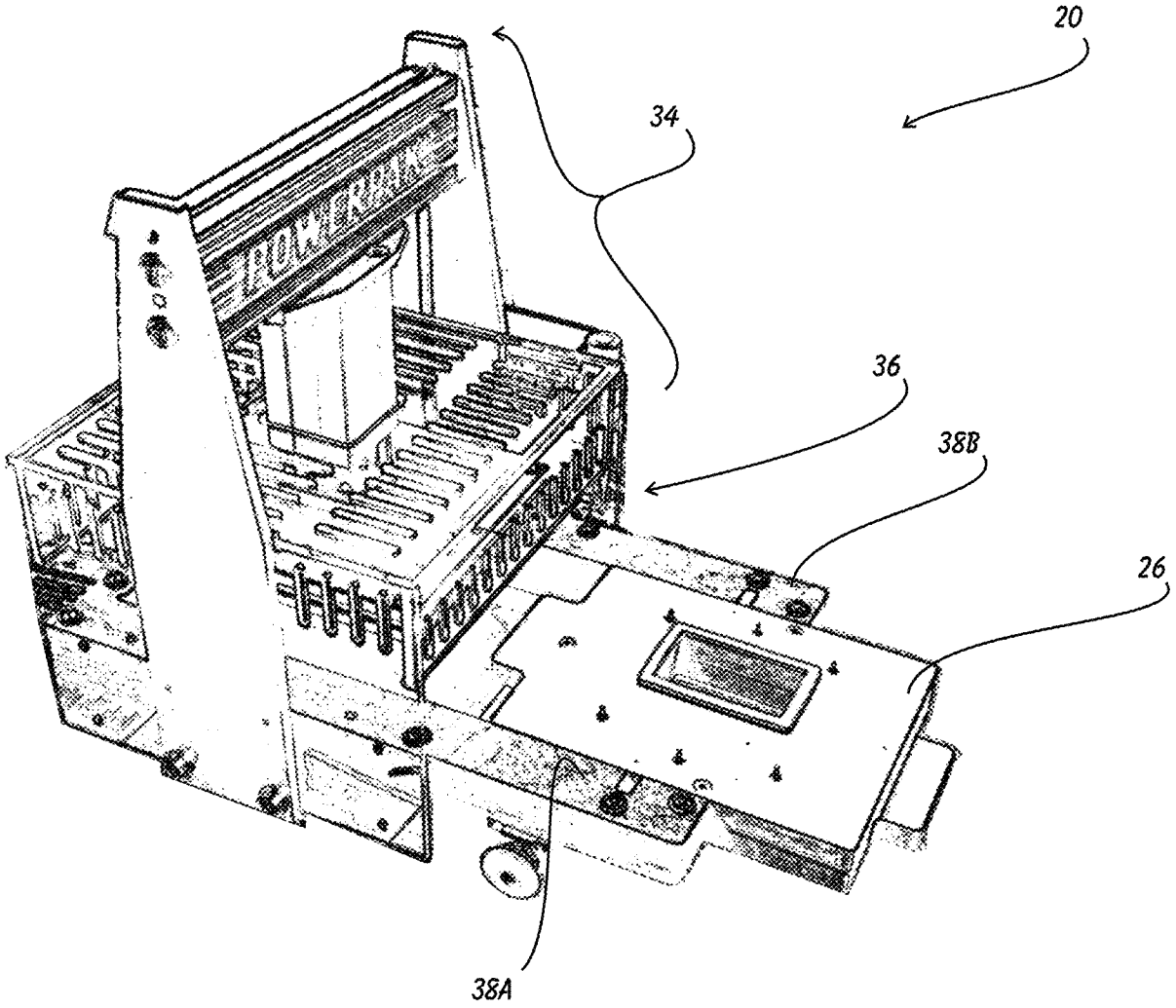
FIG. 4 is a right perspective view thereof.
Figure 5:
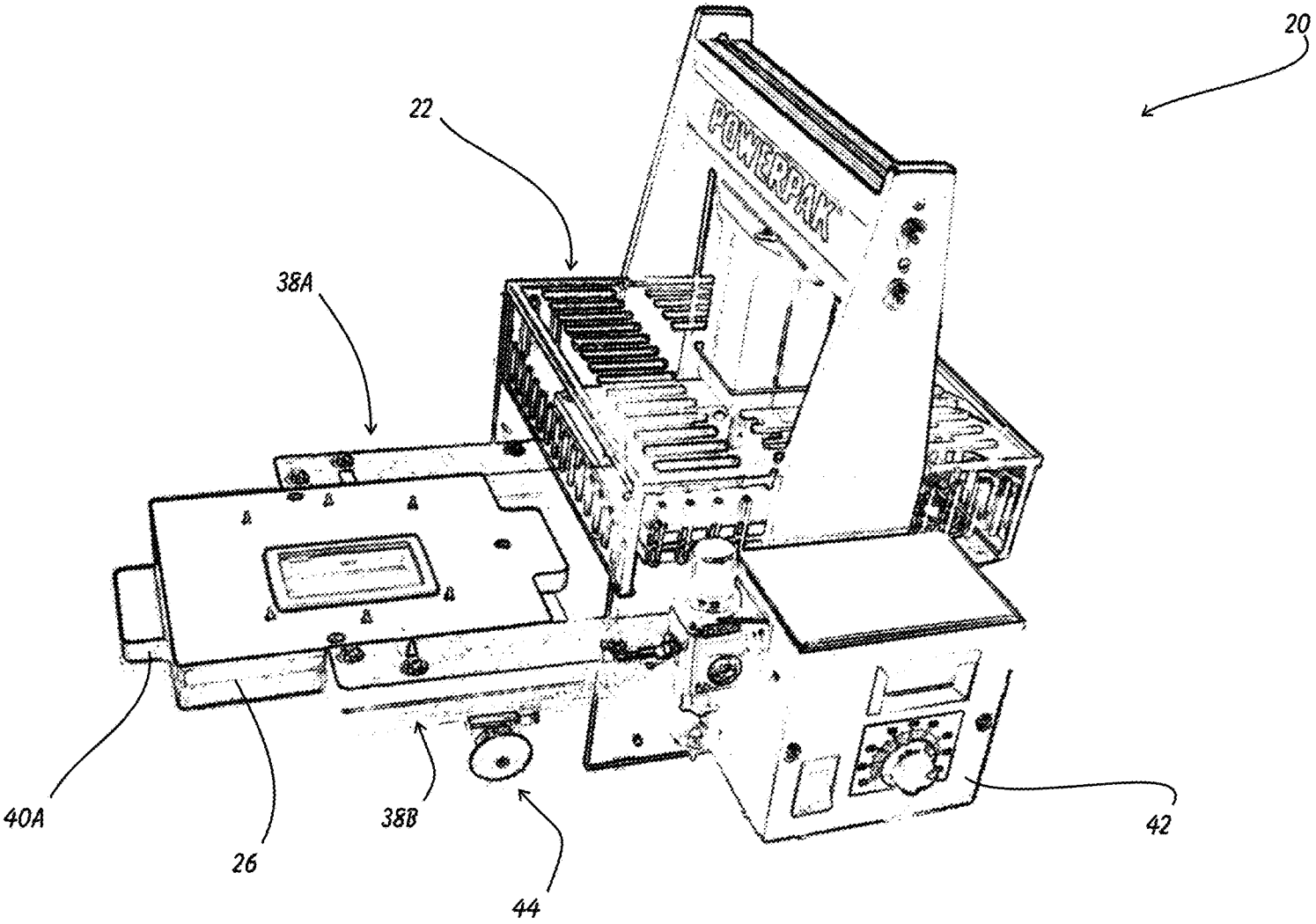
FIG. 5 is a left perspective view thereof.

The inverting nesting tray 26 has a first nest 30A on its first face 28A. The first nest 30A is defined by a bore 32 formed through the nesting tray. As with the prior devices, there is a heating press plate 22 located within a safety shield 24. When the nesting plate 26 is positioned in the sealing position (under the heating press plate 22), the plate 22 can be actuated to press down on the components residing in the nest 30A in order to complete the seal. FIGS. 4 and 5 provide additional detail on the functionality of this novel device.

FIG. 4 is a right perspective view of the blister sealer having an invertible nesting tray 20. The nesting tray 26 is supported by a pair of parallel, spaced rails 38A, 38B. The rails 38A and 38B extend horizontally from the mouth 36 of the heater press assembly 34, and terminate in distal ends. FIG. 5 is a left perspective view of the device 20. A first handle 40A extends from the distal end of the invertible nesting tray 26. A heater control box 42 contains the controls that allow the user to adjust the temperature of the heating press plate 22. Control buttons 44 on each side of the machine are pressed simultaneously by the user in order to cycle the heating press plate 22 down onto the nesting tray 26 (when it is in the sealing position under the plate 22).

Figure 6:
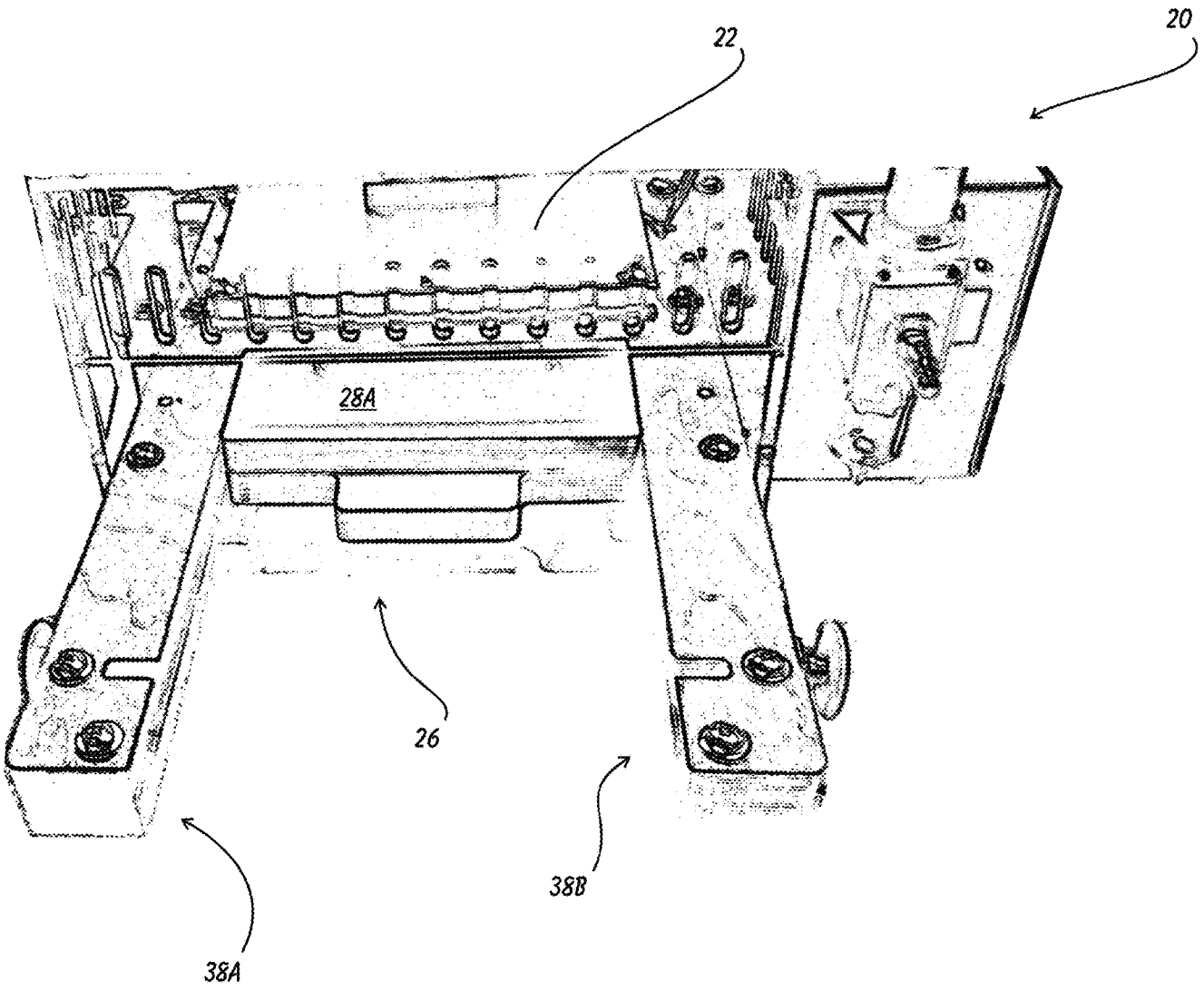
FIG. 6 is a partial front perspective view thereof with the nesting tray in the sealing position.

FIG. 6 is a partial front perspective view of the device 20 with the nesting tray 26 in the sealing position. In this position, the nesting tray 26 has been slid down the first and second rails 38A, 38B so that the first face 28A (and first nest [30A]) is positioned directly beneath the heating press plate 22. After cycling of the heating press plate 22, the nesting tray 26 would typically be moved by the user to the orientation shown in FIG. 7.

Figure 7:
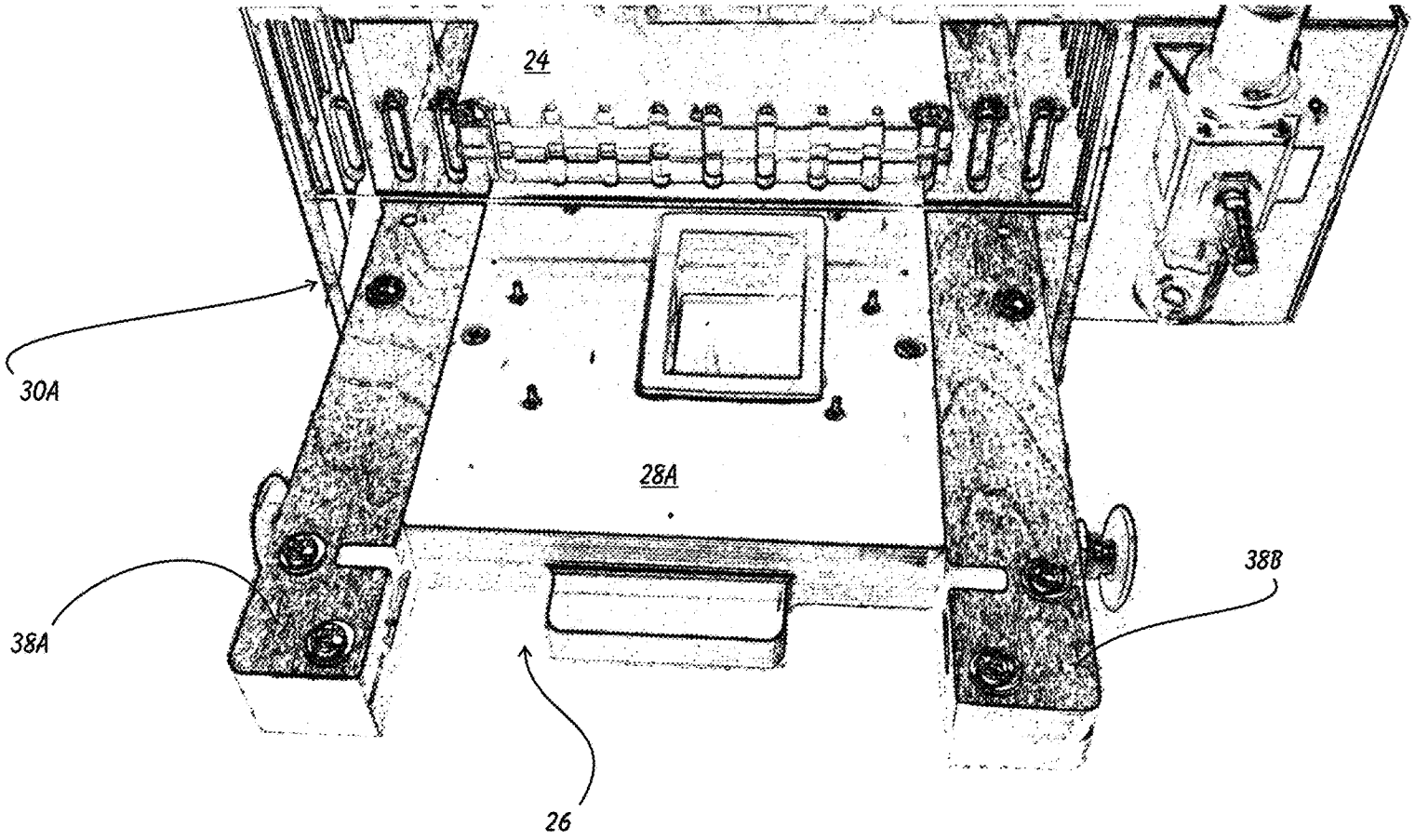
FIG. 7 is a second partial front perspective view of the device of FIG. 3 with the nesting tray in a transitional zone position.

FIG. 7 is a second partial front perspective view of the device 20 of FIG. 3 with the nesting tray 26 in a transitional zone position. The "transitional zone" extends from the "sealing position" to the "distal position," and essentially describes the zone along the rails 38A, 38B in which the nesting tray 26 can transit. As seen here, the first face 28A is still facing up. This will remain the case until the nesting tray 26 has cleared the edge of the safety shield 24.

Figure 8:
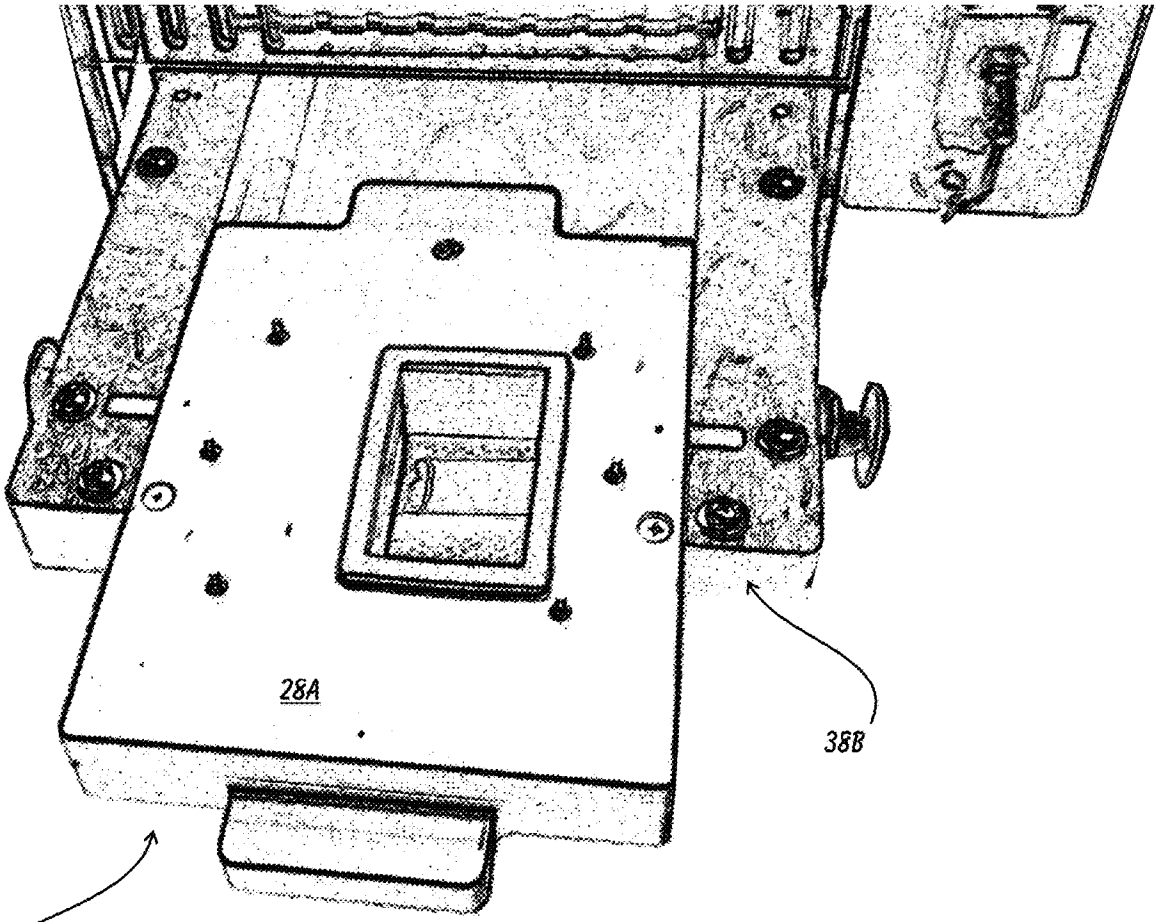
FIG. 8 is another partial front perspective view of the device of FIG. 3 with the nesting tray in the distal position.
Figure 9:
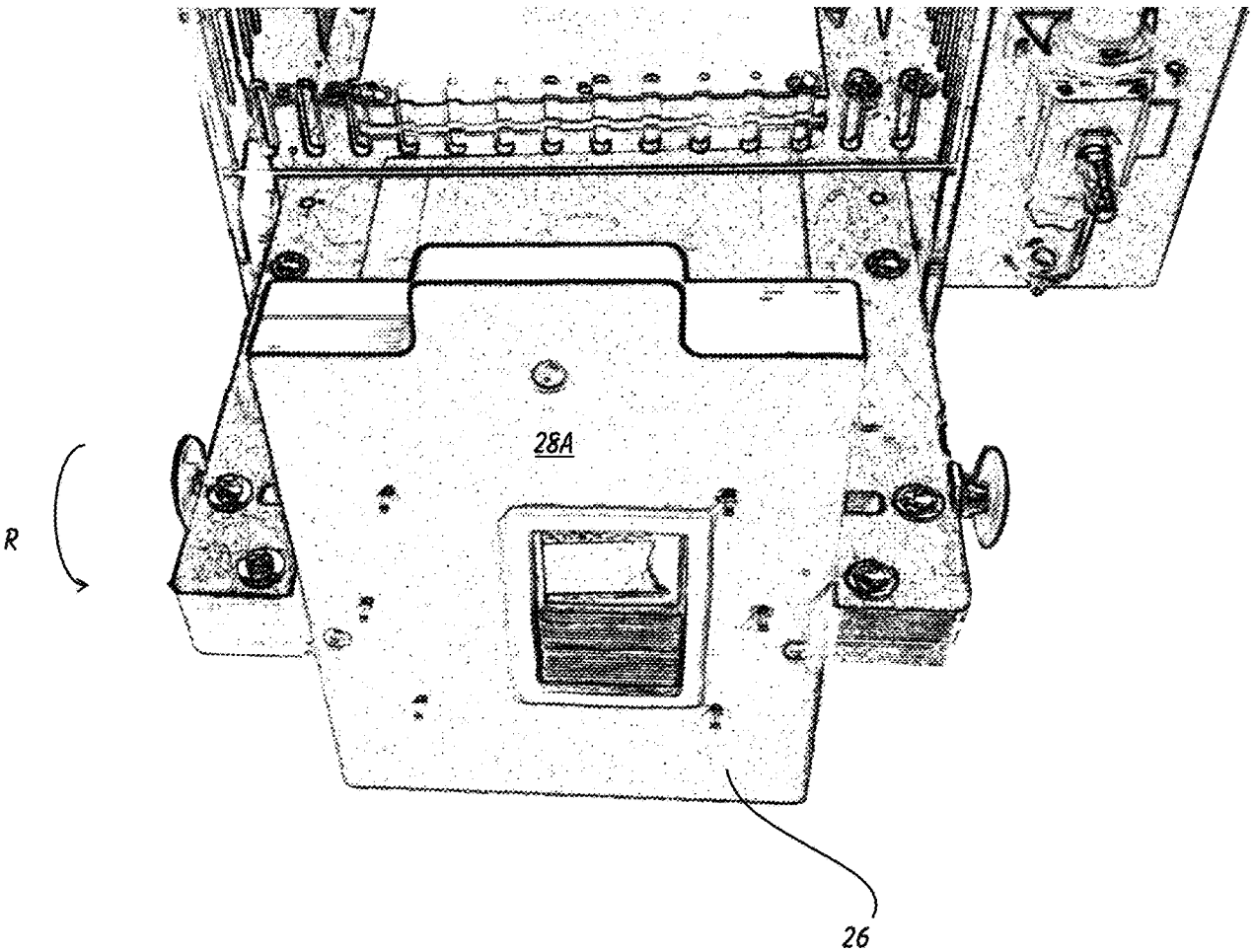
FIG. 9 depicts the nesting tray in a partially inverted position.
Figure 10:
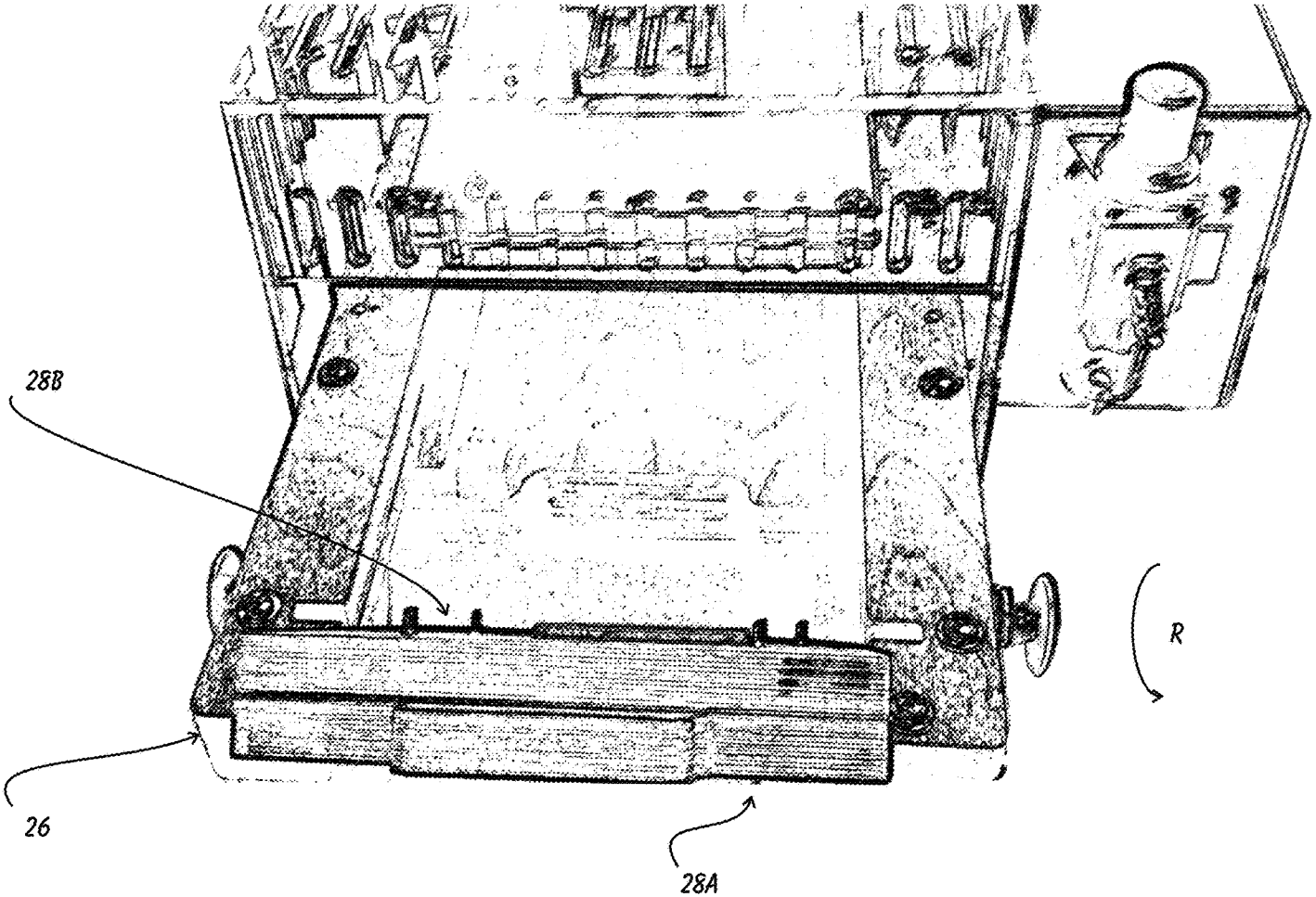
FIG. 10 depicts the nesting tray in further partially inverted position.
Figure 11:
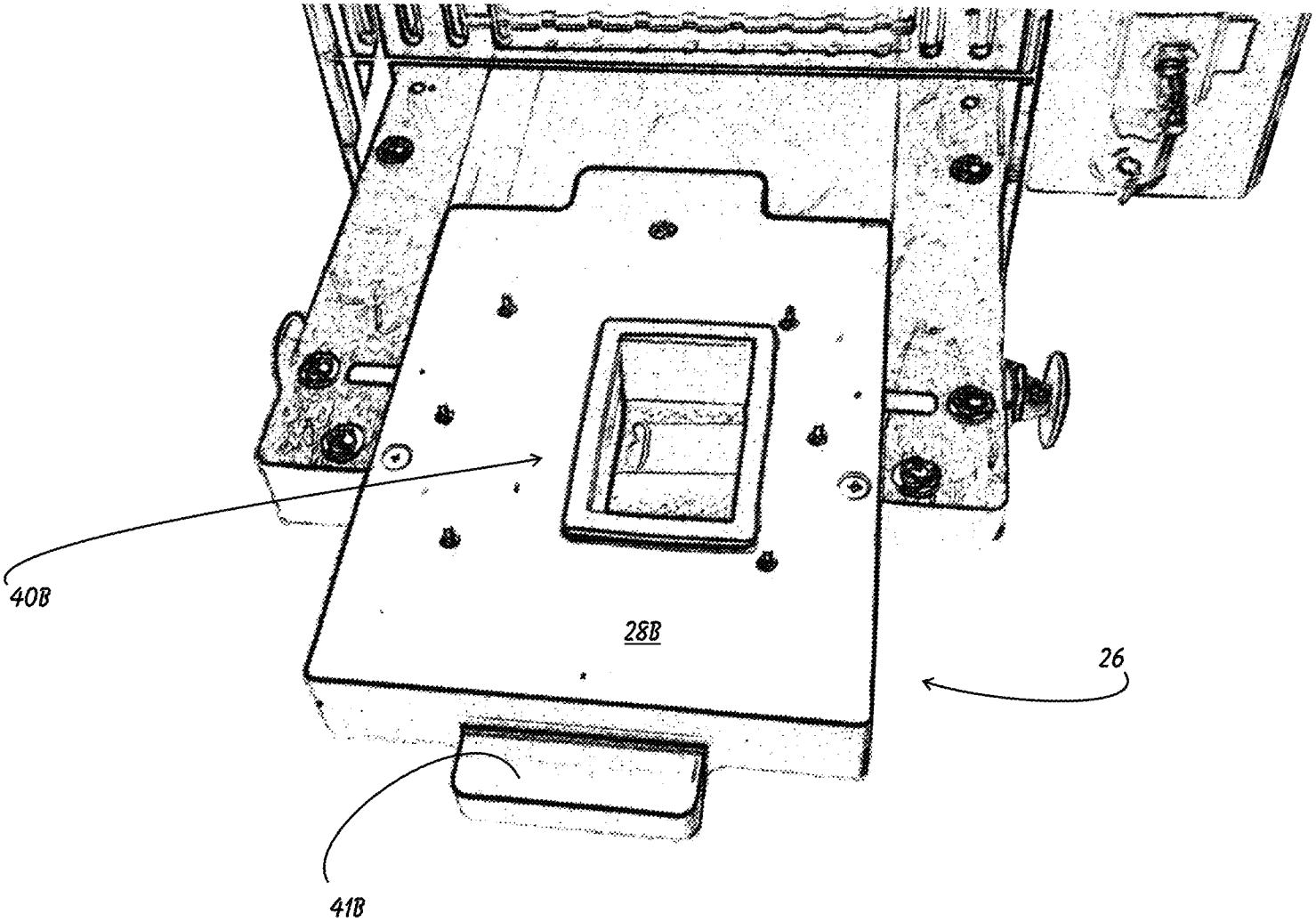
FIG. 11 depicts the nesting tray in the fully inverted position.

FIG. 8 depicts the next sequential position for the nesting tray 26, which is the distal position—at the distal ends of the first rail 38A and second rail 38B. As shown, the first face 28A is still facing up. In FIG. 9, the nesting tray 26 has begun being rotated in direction "R" so that the first face 28A is now facing forward (vs straight up as in FIG. 8). FIG. 10 shows the nesting tray 26 as it rotates further in direction "R" so that the second face 28B of the nesting tray 26 has begun to be exposed, and the first face 28A has begun to be hidden. FIG. 11 shows the final, fully rotated position of the nesting tray 26. Here, the second face 28B is facing directly up so that the second nest 40B is ready for loading. The second handle 40B is now extending from the now-distal edge of the nesting tray 26. If we now turn to FIG. 12, we can examine certain features of the design in more detail.

Figure 12:
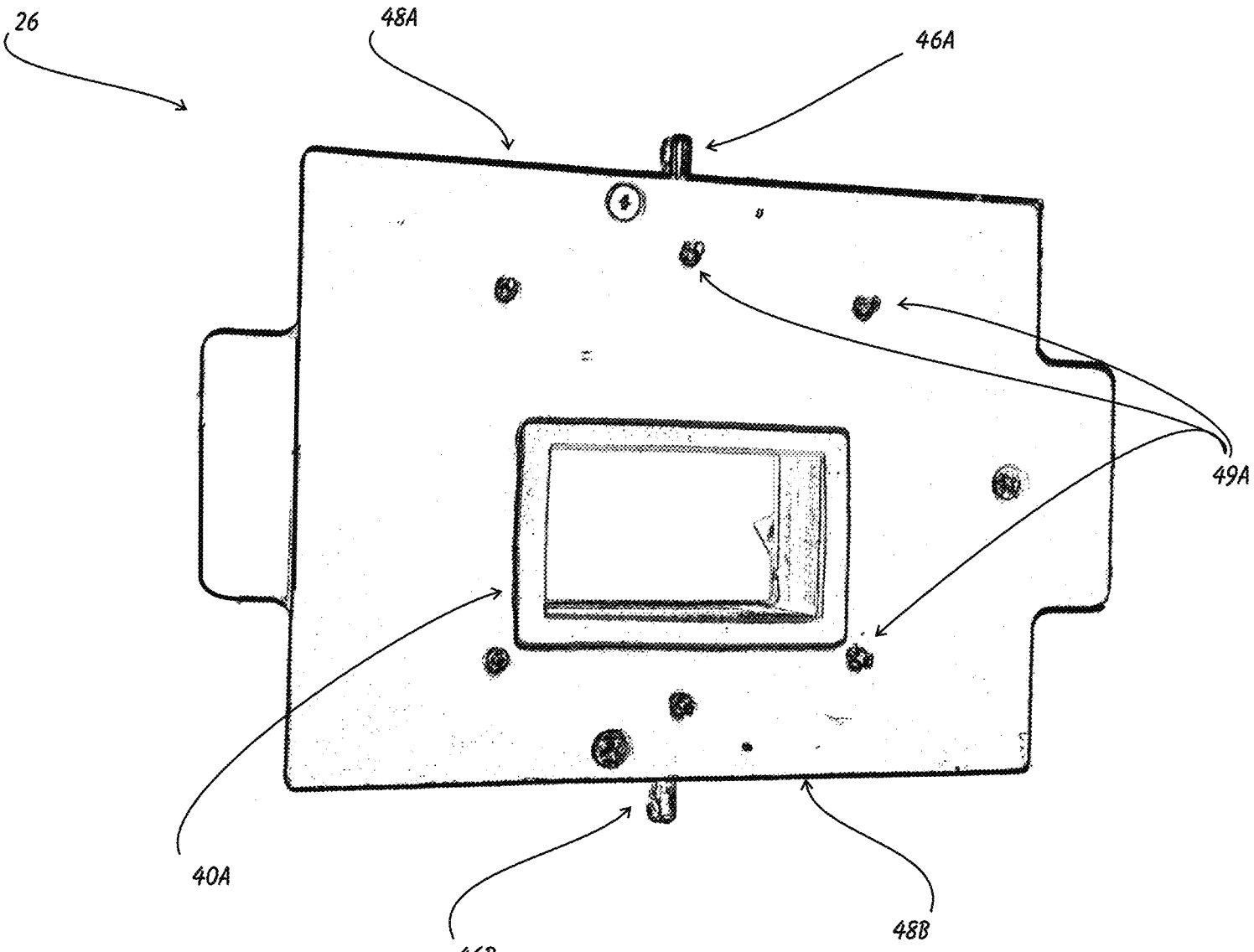
FIG. 12 is a top view of the nesting tray of the device of FIG. 3.
Figure 13:
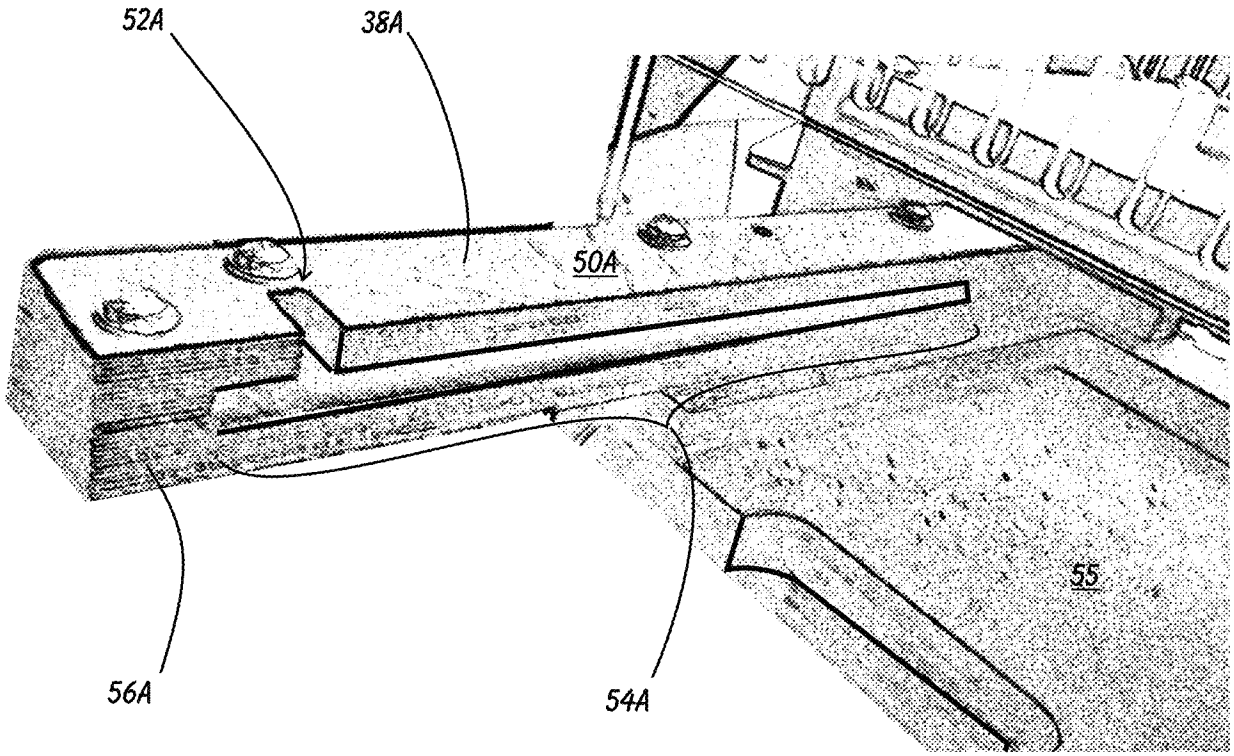
FIG. 13 is a partial perspective view of a first rail of the device of FIG. 3.

FIG. 12 is a top view of the nesting tray 26 of the device [20] of FIG. 3. The nesting tray 26 is defined by a pair of opposing sidewalls 48A, 48B. First and second axles 46A, 46B extend outwardly from the sidewalls 48A, 48B. These axles 46A, 46B support the nesting tray 26 within the rails [38A, 38B], and also allow the nesting tray 26 to be rotatable. Each face (first face 28A shown here) typically will have a plurality of alignment pegs 49A extending upwardly from it. These alignment pegs 49A (49B extend from the second face) insert within bores formed in the face of the heating press plate [22] to make sure that the nest 40A is properly aligned with the heating press plate [22] when the plate [22] descends to press down and seal the blister/clamshell package. FIG. 13 provides detail regarding the rails.

FIG. 13 is a partial perspective view of a first rail 38A of the device [20] of FIG. 3. As should be apparent, the second rail [38B] has the identical features as does the first rail 38A, arranged in the mirror image of the first rail 38A.

The rail 38A is defined by a top face 50A and an inside face 56A. The inside face 56A has a side channel 54A formed within it. There is also a top notch 52A that interconnects the side channel 54A with the top face 50A. The side channel 54A and top notch 52A are sized to accommodate the diameter and length of the axle [46A]. The top notch 52A is provided so that the nesting tray [26] can be removed and reinserted between the rails [38A, 38B]. The side channel 54A extends from end to end so that the nesting tray 26 can transition between the distal position and the sealing position. The base 55 from which the heating press plate [22] mechanism and rails [38A, 38B] extend. The rails [38A, 38B] are collectively referred to as forming a portion of the base assembly.

Figure 14:
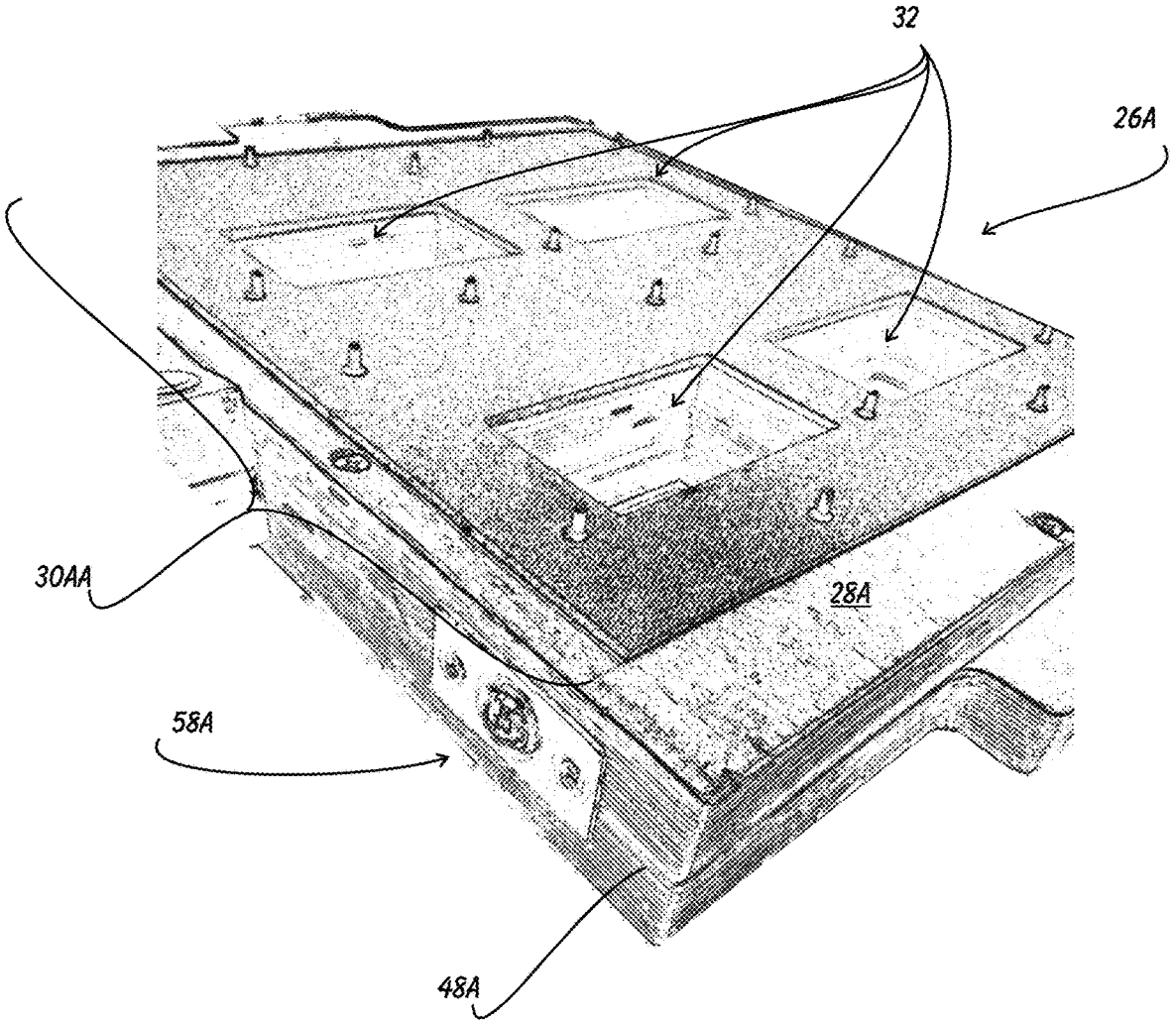
FIG. 14 is a perspective view of a second embodiment of a nesting tray of the device of FIG. 3.

FIG. 14 is a perspective view of a second embodiment 26A of a nesting tray of the device [20] of FIG. 3. In this version, the first nest 30AA has four individual bores 32 so that four packages can be sealed at the same time. This is not always possible, based upon the size of the package being sealed, but in some cases it will be designed in this way.

Another feature of this tray 26A is the first retaining assembly 58A disposed on the sidewall 48A. The retaining assembly 58A creates an interference fit between the side of the nesting tray 26A and the side face [56A] of the first rail [38A] when the nesting tray 26A has been rotated so that the first face 28A is oriented to be straight up (i.e. in preparation for loading). In this version, the retaining assembly 58A is a "ball detent" system that employs a spring-loaded ball that will push into a divot formed in the side face [56A] of the first rail [38A]. There may be divots formed at the distal end of the rail [38A] as well as at the sealing end of the rail [38A]. In this way, the nesting tray 26A would be held in place by the retaining assembly 58A when the nesting tray 26A is at the distal position, as well as when it is at the sealing position. Finally moving to FIG. 15, we can review the steps involved in utilizing the device [20] to create blister or clamshell packages.

Figure 15:
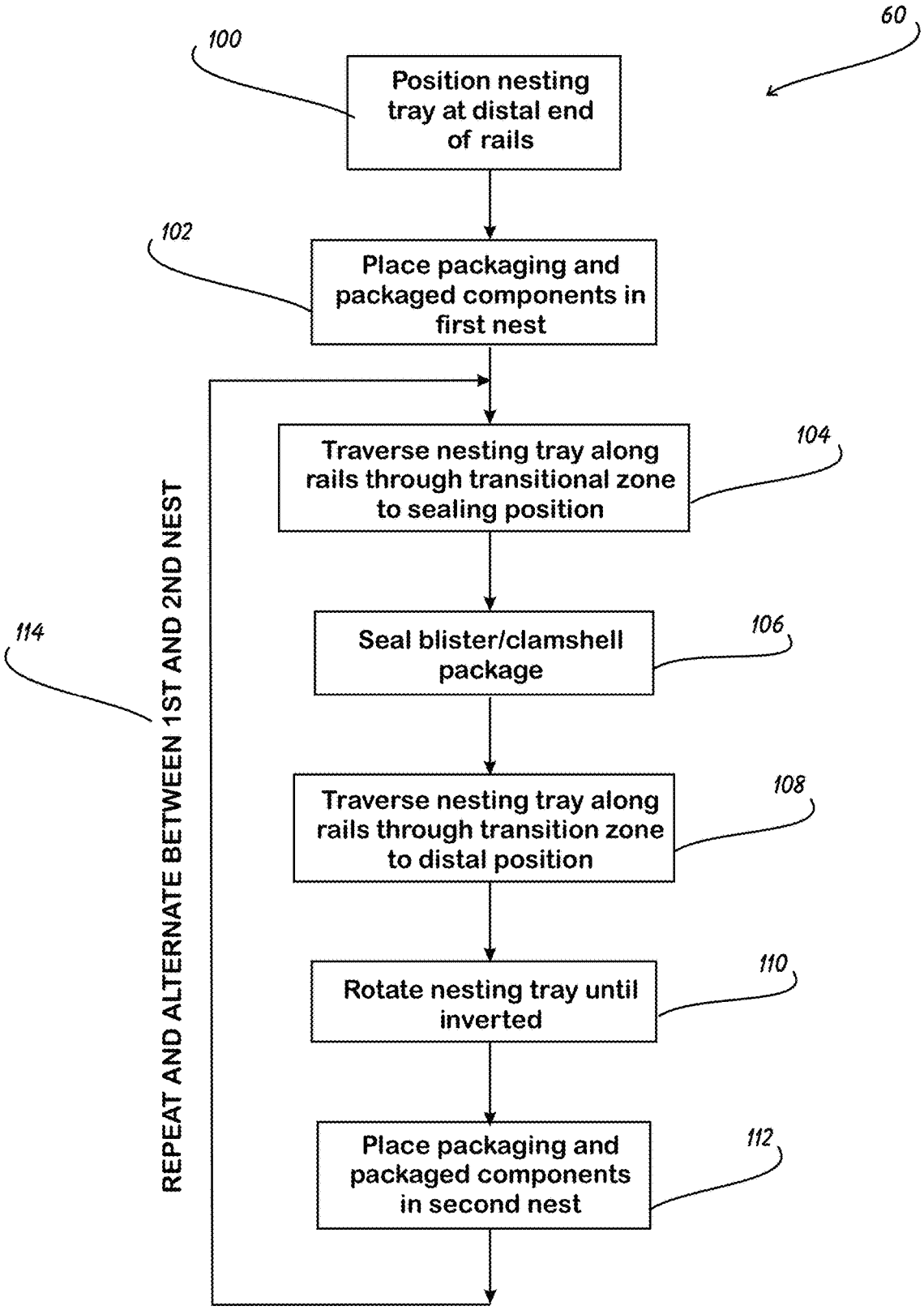
FIG. 15 is a flowchart of a preferred blister/clamshell sealing method utilizing the device of the present invention.

FIG. 15 is a flowchart of a preferred blister/clamshell sealing method 60 utilizing the device of the present invention. The nesting tray is first positioned at the distal end of the rails 100. The packing components and the item to be sealed within the package are then placed within the first nest 102 (or the second nest, if the second nest is facing up).

The user then pushes the nesting tray along the rails through the transitional zone until it reaches the sealing position 104. The blister/clamshell is then sealed 106 by pressing the heating press onto the first nest. The user then pulls the nesting tray back along the rails from the sealing position to the distal position 108. The user then rotates the nesting tray until it is inverted and the second nest is facing up 110 (or vice-versa, depending on the orientation of the nesting tray at steps 100 and 102). When the nesting tray is inverted, the just-sealed package should drop out of the first nest. The user then places packaging and components to be packaged into the second nest 112 and traverses the nesting tray along the rails through the transition zone until it reaches the sealing position 104. These series of steps are repeated 114 to alternate between the first and second nests being filled and packages being sealed.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A blister sealer for sealing packages, comprising:

a base assembly;

a nesting tray pivotally attached to said base and positionable in a sealing position, said pivotal attachment configured to permit said nesting tray to rotate along an axis that is non-vertical, said nesting tray defining a first side and a second side, wherein said first side faces in a first direction and said second side faces in a second direction, and said first and second directions are different; and a heating press plate attached to said base and juxtaposed above said nesting tray when said nesting tray is in said sealing position and operable to press down on said nesting tray.

2. The blister sealer of claim 1, further comprising:

a base;

a pair of rails extending from said base; and wherein said nesting tray is pivotally attached to said rails.

3. The blister sealer of claim 2, wherein said nesting tray is slidingly attached to said rails to slide between said sealing position and a distal position wherein said nesting tray is positioned adjacent to a distal end of said rails.

4. The blister sealer of claim 3, further defining a transitional zone for positioning said nesting tray along said rails, said transitional zone defined as a zone between said sealing position and said distal position.

5. The blister sealer of claim 4, wherein each said side of said nesting tray comprises at least one blister nest formed therein.

6. The blister sealer of claim 5, wherein each said blister nest comprises at least one bore formed in said nesting tray.

7. The blister sealer of claim 6, wherein:

each said rail is defined by a channel formed therein; and said nesting tray is defined by a first axle extending from a first side and a second axle extending from an opposing second side, said channels configured to accept said first and second axles therein to permit said pivotal and sliding attachment of said nesting tray to said rails.

8. The blister sealer of claim 7, wherein said nesting tray is further defined by third and fourth opposing sides and at least one handle protruding from said third or said fourth side of said nesting tray.

9. The blister sealer of claim 8, wherein said rails further include a top notch formed between a top surface of said rail and said channel formed in said rail, said top notches configured to accept said first and second axles therethrough.

10. The blister sealer of claim 9, further comprising at least one retaining assembly extending from said first or second side of said nesting tray, each said retaining assembly inhibiting the pivoting of said nesting tray relative to said rails.

11. An apparatus for bonding a pair of packaging components to one another to form a blister package with packaged contents trapped therein, comprising:

at least one rail;

a nesting tray pivotally attached to said rail and positionable in a sealing position, said nesting tray defining at least one nest on a first side and at least one nest on a second side, wherein said first side faces in a first direction and said second side faces in a second direction, and said first and second directions are opposite to one another; and a heating press plate positioned adjacent to said rail and juxtaposed above said nesting tray when said nesting tray is in said sealing position and operable to press down on said nesting tray.

12. The apparatus of claim 11, wherein:

each said rail is defined by a channel formed therein; and said nesting tray is defined by a first axle extending from a first side and a second axle extending from an opposing second side, said channels configured to accept said first and second axles therein to permit said pivotal and sliding attachment of said nesting tray to said rails.

13. The apparatus of claim 12, wherein said nesting tray is further defined by third and fourth opposing sides and at least one handle protruding from said third or said fourth side of said nesting tray.

14. The apparatus of claim 13, wherein said nesting tray is slidingly attached to said at least one rail to slide between said sealing position and a distal position wherein said nesting tray is positioned adjacent to a distal end of said at least one rail.

15. The apparatus of claim 14, further defining a transitional zone for positioning said nesting tray along said rails, said transitional zone defined as a zone between said sealing position and said distal position.

16. The apparatus of claim 15, further comprising at least one retaining assembly extending from said first or second side of said nesting tray, each said retaining assembly inhibiting the pivoting of said nesting tray relative to said rails.

* * * * *